United States Patent [19]

Hoskins

[11] Patent Number: 4,483,221

[45] Date of Patent: Nov. 20, 1984

[54] PLIERS-TYPE TOP OPENER

[76] Inventor: Nathan D. Hoskins, 6 Maywood Dr., Jackson, Tenn. 38301

[21] Appl. No.: 485,464

[22] Filed: Apr. 8, 1983

[51] Int. Cl.[3] ..... B67B 7/18

[52] U.S. Cl. ..... 81/3.44; 81/420; 81/415

[58] Field of Search ..... 81/3.44, 3.4, 418, 415, 81/420, 421, 422, 424, 425 R; 7/125

[56] References Cited

U.S. PATENT DOCUMENTS

| | | | |
|---|---|---|---|
| 1,500,308 | 7/1924 | Goldberg | 81/3.44 |
| 2,441,743 | 5/1948 | Albert | 81/3.44 |
| 3,389,622 | 6/1968 | Flugel | 81/3.44 |
| 4,327,607 | 5/1982 | Morris | 81/425 R |

FOREIGN PATENT DOCUMENTS

| | | | |
|---|---|---|---|
| 2743710 | 4/1979 | Fed. Rep. of Germany | 81/3.44 |
| 26174 | of 1909 | United Kingdom | 81/3.44 |

*Primary Examiner*—Roscoe V. Parker
*Attorney, Agent, or Firm*—Young & Thompson

[57] ABSTRACT

A pliers-type top opener has a pair of pivotally interconnected handles each having a gripper at one end. Each handle is bent from sheet steel and has a flat intermediate portion. The flat intermediate portions of the handles are pivotally interconnected for relative swinging movement about an axis passing through and perpendicular to the flat intermediate portions. The sheet steel of the handles is bent substantially 90° about a helical bend out of the plane of the intermediate portion to form an end portion carrying the gripper. Each gripper has a web that extends from an edge of that end portion away from the other gripper and terminates in a flange which extends from the edge of each web remote from the other web, only in a direction away from the plane of the flat portion. Each web is spaced a substantial distance to one side of that plane, so that all portions of the flanges are spaced a substantial distance from that plane. The flanges are concave, and open toward each other to grasp a top between them when the handles are brought together. Each said flange has a concavity deeper than circular, so as to contact container tops at four peripherally spaced points about the top.

2 Claims, 6 Drawing Figures

PLIERS-TYPE TOP OPENER

The present invention relates to top openers for removing or tightening the screw tops on any of a variety of containers of various sizes. Among the containers whose tops can be removed or tightened by the opener according to the present invention, are those for beverages, cooking oil, sauces, catsup, finger nail polish remover, and brake fluid, among many others.

It is known to provide top openers of the pliers type, with two pivotally interconnected handles gripped by the user at one end and having grippers at the opposite end for grasping the container top to be removed or tightened, in the manner of first class levers. As is well known, when the handles are swung clockwise, the top will be tightened on the container; but when the handles are swung counterclockwise, then the top will be loosened or removed.

However, such top openers as known heretofore have a number of disadvantages. In the first place, they are not useful with container tops of all diameters: if the opener conveniently grips a small top, then the jaws and handles will be spread too wide for convenient use with a large top; but if the opener is convenient to use with a large top, then it cannot grip a small top.

Another disadvantage of known top openers is that they require the production of a plurality of different parts. Still another disadvantage, is that they require costly machining and assembly procedures.

It is accordingly an object of the present invention to provide a top opener which is usable with any of a variety of sizes of tops.

Another object of the present invention is the provision of such an opener, which contains a minimum number of different parts.

Finally, it is an object of the present invention to provide such a top opener, which will be simple and inexpensive to manufacture, easy to assemble and operate, and rugged and durable in use.

Other objects, features and advantages of the present invention will become apparent from a consideration of the following description, taken in connection with the accompanying drawing, in which.

Figure 1:
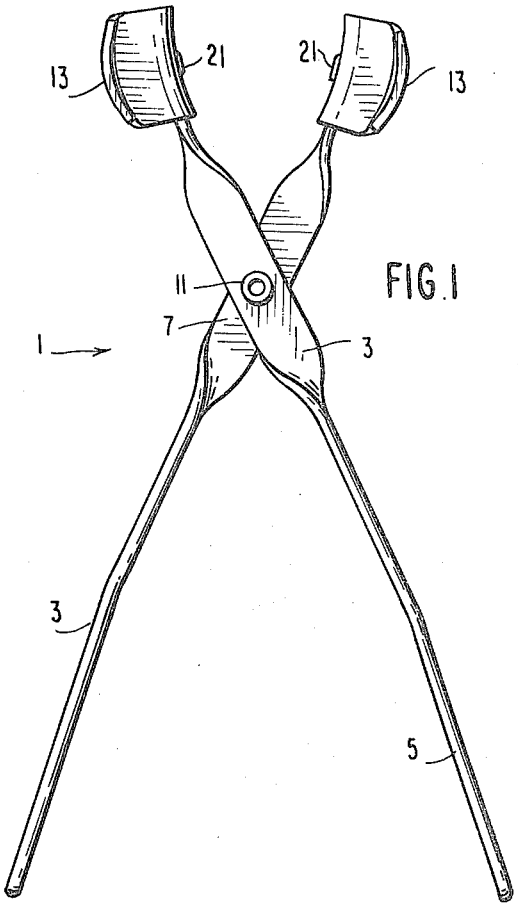
FIG. 1 is a view of a top opener according to the present invention, in open position.

Referring now to the drawing in greater detail, there is shown a top opener 1 according to the present invention, of the pliers type, comprising a pair of identical handles 3 each of which is bent from steel strip stock. Each handle 3 has an operating portion 5 to be gripped in the hand of the user and an intermediate portion 7 which is bent about a helical bend 90° from operating portion 5. Beyond intermediate portion 7, handle 3 terminates in an end portion 9 which again is bent 90° about a helical bend out of the plane of intermediate portion 7, in the same direction that portion 7 was bent out of the general plane of operating portion 5.

Figure 2:
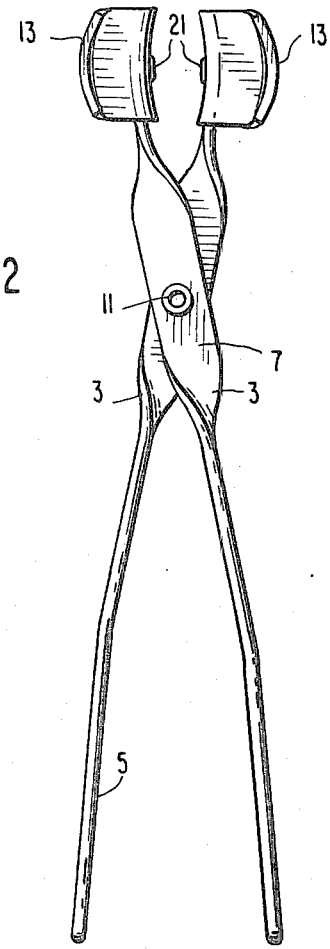
FIG. 2 is a view similar to FIG. 1, but showing the opener in closed position.
Figure 3:
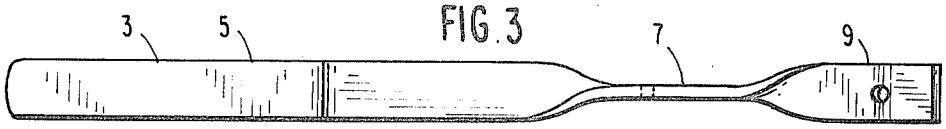
FIG. 3 is a view of a handle of an opener according to the present invention.
Figure 4:
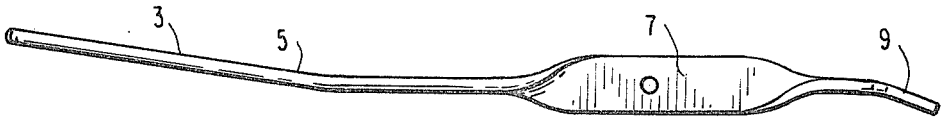
FIG. 4 is a view similar to FIG. 3, but with the handle rotated 90°.
Figure 5:
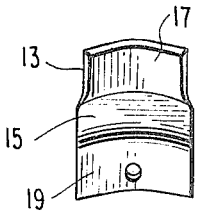
FIG. 5 is a perspective view of a gripper according to the present invention.
Figure 6:
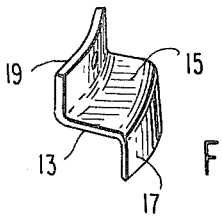
FIG. 6 is a view similar to FIG. 5, but rotated 90°.

Notice that operating portion 5 and end portion 9 of each handle 3 are concave in opposite directions, while intermediate portion 7 is flat. The intermediate portions 7 of two handles 3 are pivotally interconnected by a pin or rivet 11; and the 90° relationships referred to above are only slightly modified so as to permit operating portions 5 and end portions 9 of the two handles 3 to overlie each other when viewed from the side, that is, either side of FIG. 1 or FIG. 2. The intermediate portions 7 are flat for a distance sufficient to permit their sliding movement in surface to surface contact with each other to a closed position as seen in FIG. 2, that is, for a substantial distance on each side of rivet 11.

A gripper 13 is secured to each end portion 9, and comprises a flat intermediate web 15 disposed in a plane parallel to that of intermediate portion 7, and a pair of flanges 17 and 19 which extend in opposite directions, one from either edge of web 15. Thus, an outer flange 17 is provided, for use with relatively large tops; while an inner flange 19 is provided, for use with relatively small tops.

Flanges 17 and 19 are concave; and in assembled relationships, the concavities of the respective flanges 17 and 19 on the two end portions 9 open toward each other, as do also the concavities of operating portions 5 and end portions 9 of the respective handles 3.

However, the concavity of flanges 17 and 19 is not circular but rather is deeper than circular, e.g. oval or elliptical or parabolic or hyperbolic or even V-shaped. This can be achieved in any of a variety of ways by bending the metal of grippers 13, and is for the purpose of ensuring that the flanges 17 and 19 will make four-point contact with the top they are to grip. This four-point contact makes it easier to remove the top, because there is no binding of the top about a wide perimeter as would be the case if the gripping surfaces were circular and of the same radius as the top that is gripped.

Each gripper 13 is fixedly secured to its respective end portion 9 by a rivet 21 passing through a hole in inner flange 19 and a hole in end portion 9. In certain instances, the head of the rivet 21 on the inner side of the gripper will serve as a contact point with the top, thereby avoiding an undesirably wide peripheral contact of the gripper with the top, as explained above.

In operation, the opener of the present invention is grasped by the user by the operating portions 5 of the handles 3, on which the user exerts a grip to grasp the top of the container between one or the other pair of the flanges 17 and 19. If a large top is to be manipulated, it is grasped between the outer flanges 17 with the web 15 overlying the margins of that large top. But if a small top is to be manipulated, then it is grasped between the inner flanges 19. For this latter operation, if the flanges 17 would interfere with the sides or neck of the container thereby impairing the grip of flanges 19 on the small top, then the top opener 1 can be turned over so that the flanges 17 point up and are thus disposed out of contact with the container during the manipulation operation.

Therefore, in many instances, it will be possible to use the top opener of the present invention with the flanges 17 pointing down and the flanges 19 pointing up, both for large and for small tops; but for small tops on wide containers, the top opener can be turned with the flanges 19 down and the flanges 17 up.

Notice particularly that the present invention uses a minimum of different parts. The two handles 3, as pointed out above, are identical; the two grippers 13, as pointed out above, are identical; and in addition there are only the three rivets 11 and 21.

Notice also that the top opener of the present invention requires a minimum of manufacturing operations: the handles 3 are easily bent from standard steel strip stock and need only be drilled each with two holes. Only one set of bending equipment is necessary, because the handles 3 are identical; and the same is true for the grippers 13.

Notice that the assembly operation requires only three riveting operations.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A pliers-type top opener, comprising a pair of pivotally interconnected handles each having a gripper at one end, each handle being bent from sheet steel, each handle having a flat intermediate portion, means pivotally interconnecting the flat intermediate portions of the handles for relative swinging movement about an axis passing through and perpendicular to the flat intermediate portions, the sheet steel of the handles being bent substantially 90° about a helical bend out of the plane of the intermediate portion to form an end portion carrying the gripper, each gripper having a web that extends from an edge of said end portion away from the other gripper and terminates in a flange which extends from the edge of each web remote from the other web, only in a direction away from said plane of said flat portion, each web being spaced a substantial distance to one side of said plane whereby all portions of said flanges are spaced a substantial distance from said plane, said flanges being concave and opening toward each other to grasp a top between them when said handles are brought together.

2. A top opener as claimed in claim 1, in which each said flange has a concavity deeper than circular, thereby to contact container tops at four peripherally spaced points about the top.

* * * * *